US008490554B2

(12) United States Patent
Jin

(10) Patent No.: US 8,490,554 B2
(45) Date of Patent: Jul. 23, 2013

(54) FOLDABLE TABLE

(76) Inventor: Ki Ho Jin, Xiamen (CN)

( * ) Notice: Subject to any disclaimer, the term of this patent is extended or adjusted under 35 U.S.C. 154(b) by 0 days.

(21) Appl. No.: 13/537,450

(22) Filed: Jun. 29, 2012

(65) Prior Publication Data

US 2013/0000528 A1 Jan. 3, 2013

(30) Foreign Application Priority Data

Jun. 30, 2011 (CN) ..... 2011 2 0227703
Jun. 30, 2011 (WO) ..... PCT/CN2011/076654
Jun. 30, 2011 (WO) ..... PCT/CN2011/076686
Aug. 2, 2011 (CN) ..... 2011 2 0278190

(51) Int. Cl.
*A47B 3/00* (2006.01)

(52) U.S. Cl.
USPC ..... 108/132; 108/133

(58) Field of Classification Search
USPC ..... 108/132, 131, 133, 129, 128, 115, 108/120; 248/439, 188.6
See application file for complete search history.

(56) References Cited

U.S. PATENT DOCUMENTS 1,778,124 A * 10/1930 Sauer ..... 108/132
2,490,318 A 12/1949 Padon
2,768,866 A 10/1956 Amber
3,072,451 A 1/1963 Greenberg et al.
3,368,504 A 2/1968 Cohen
3,416,468 A 12/1968 Peterson et al.
3,606,846 A * 9/1971 Andrews et al. ..... 108/132
3,769,920 A 11/1973 Weiss
5,490,467 A * 2/1996 Diffrient ..... 108/133
5,542,639 A * 8/1996 Wixey et al. ..... 108/132
5,974,982 A 11/1999 Lepper et al.
5,983,807 A 11/1999 Tarnay et al.
6,508,184 B1 1/2003 Winter et al.
6,634,304 B2 10/2003 Wang
6,705,234 B1 * 3/2004 Miller et al. ..... 108/36
6,901,867 B2 6/2005 Strong et al.
6,920,833 B2 * 7/2005 Lou-Hao ..... 108/133
7,055,899 B2 * 6/2006 Zhurong et al. ..... 108/132

(Continued)

FOREIGN PATENT DOCUMENTS

CN 2509921 Y 9/2002
CN 2513437 Y 10/2002

(Continued)

OTHER PUBLICATIONS

PCT/CN2011/076654 International Search Report, Apr. 5, 2012.

(Continued)

*Primary Examiner* — Jose V Chen
(74) *Attorney, Agent, or Firm* — John H. Choi

(57) ABSTRACT

A foldable table includes a table top having a top surface and a bottom surface; a frame assembly disposed on a bottom surface of the table top; at least two leg assemblies pivotally coupled to the frame assembly for movement between an extended position and a folded position; at least two support members, each support member pivotally coupled to the frame assembly and to the at least two leg assemblies; and at least one locking assembly coupled to the at least two support members, each of the at least one locking assembly comprising a ramp portion integrally formed with a locking portion, a channel formed under the ramp portion for guiding and receiving a locking pin, the locking portion having an opening for receiving a pushbutton and the locking pin.

17 Claims, 6 Drawing Sheets

U.S. PATENT DOCUMENTS

| | | | | |
|---|---|---|---|---|
| 7,107,915 | B2 | 9/2006 | Laws et al. | |
| 7,644,667 | B2 * | 1/2010 | Strong et al. | 108/132 |
| 8,132,517 | B2 * | 3/2012 | Leng | 108/133 |
| 2004/0255826 | A1 | 12/2004 | Ashby et al. | |
| 2006/0070557 | A1 * | 4/2006 | Baik et al. | 108/132 |
| 2006/0260516 | A1 | 11/2006 | Chow | |
| 2007/0137534 | A1 | 6/2007 | Dhanoa et al. | |
| 2010/0170423 | A1 | 7/2010 | Chang | |
| 2010/0175594 | A1 | 7/2010 | Leng | |
| 2011/0030589 | A1 | 2/2011 | Chen | |

FOREIGN PATENT DOCUMENTS

| | | | |
|---|---|---|---|
| CN | 2754441 | Y | 2/2006 |
| CN | 201256727 | Y | 6/2009 |
| CN | 201403757 | Y | 2/2010 |

OTHER PUBLICATIONS

PCT/CN2011/076686 International Search Report, Apr. 5, 2012.

* cited by examiner

FOLDABLE TABLE

CROSS REFERENCES TO RELATED APPLICATIONS

This application claims priority to China Application Nos. 201120278190.5 (filed Aug. 2, 2011) and 201120227703.X (filed Jun. 30, 2011), and corresponding PCT Application Nos. PCT/CN2011/076654 and PCT/CN2011/076686 (both filed Jun. 30, 2011), respectively, which are incorporated by reference in their entireties.

BACKGROUND OF THE INVENTION

The present invention relates generally to furniture, and in particular to foldable tables and foldable benches, and the manufacturing thereof.

Foldable tables and benches are furniture items for folding or collapsing when not in use to facilitate storage, and unfolding or extending for use. Foldable tables in the prior art generally comprise a table top, a leg portion and a support portion, with upper ends of the leg portion forming a connection with the table top. Some examples of folding tables are described in U.S. Pat. No. 8,042,476 issued to Stanford on Oct. 25, 2011 ("Stanford") and U.S. Pat. No. 6,508,184 issued to Winter et al. on Jan. 21, 2003 ("Winter").

In Stanford, the support portion or folding mechanism of the table comprises a first pivotal-connection portion 100 for pivotally connecting with the leg portion 80, a second pivotal-connection portion 122 for pivotally connecting with the table top 12 and a ring or a sleeve 108. To expand the support portion of the table, the first and second pivotal-connection portions 100, 122 are extended and secured in the extended position by the ring 108 such that pivotal movement between the first pivotal-connection portion 100 and the second pivotal-connection portion 122 is restricted. To fold the support portion, the ring 108 is disengaged, and the first and second pivotal-connection portions 100, 122 are collapsed toward each other. Each component of the support portion or folding mechanism is constructed of metal and is completely exposed. Thus, a user must make direct contact with those components and often times a force must be exerted on the exposed metal components to fold and unfold the table.

The table in Winter includes a mounting assembly having a support strut 36, and a slotted member 52 both pivotally attached to an L-bracket 39 underneath the table. The slot 58 in the slotted member 52 engages a sliding member, i.e., a fastener such as a knob or wingnut (not shown) disposed on the leg 18. In the alternative, the slot 58 includes an end portion with a larger opening so that a similarly sized sliding member could lock into the larger opening. In either configuration, the components of the mounting assembly are metal plates and direct hand manipulation is required to lock and unlock the leg 18.

There are several disadvantages to the aforementioned foldable tables. For instance, locking and unlocking the legs is work-intensive and requires sufficient hand strength due to the frictional engagements of the ring and the fastener. Due to the force required to lock and unlock the legs and the various metal components of the locking mechanism, there is a risk of injury as well. Furthermore, the table height is not adjustable and therefore the tables cannot be used for multiple purposes.

A need exists, therefore, for a foldable table that is capable of being safely and easily expanded and folded, without requiring excessive force to lock and unlock the legs. A foldable table with the capability to adjust the height is also needed. The present invention satisfies these needs and provides other advantages and benefits that will be apparent from the following disclosure.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Briefly stated, to achieve the objectives stated above, the present invention includes a foldable table comprising a table top having a top surface and a bottom surface. A frame assembly is disposed on a bottom surface of the table top and at least two leg assemblies are pivotally coupled to the frame assembly. Each of the at least two leg assemblies are movable between an extended position whereby each leg assembly is substantially perpendicular to the bottom surface of the table top and a folded position whereby each leg assembly is substantially parallel and adjacent to the bottom surface of the table top. The foldable table also includes at least two support members. Each support member is pivotally coupled to the frame assembly and to the at least two leg assemblies. Furthermore, at least one locking assembly is coupled to the at least two support members. Each of the at least one locking assembly comprises a ramp portion integrally formed with a locking portion. A channel is formed under the ramp portion for guiding and receiving a locking pin. The locking portion has an opening for receiving a pushbutton and the locking pin.

In another aspect of the present invention, a foldable table comprises: a table top having a top surface and a bottom surface; a frame assembly having a pair of spaced apart side rails, each side rail fixedly coupled to the bottom surface of the table top; a pair of leg assemblies, each leg assembly having a pair of spaced apart legs pivotally coupled to the frame assembly, each leg having a spring-biased locking pin extending from an outer surface of the leg and a corresponding jacket member slidably coupled to the leg; and a plurality of support members each having a proximal end and a distal end, the proximal end of each of the plurality of support members fixedly pivotally connected to a corresponding side rail and the distal end of each of the plurality of support members pivotally coupled to a corresponding jacket member. Each leg assembly is movable between an extended position whereby each leg assembly is substantially perpendicular to the bottom surface of the table top when the locking pin and jacket member are fixedly engaged, and a folded position whereby each leg assembly is substantially parallel and adjacent to the bottom surface of the table top when the locking pin and jacket member are disengaged.

In yet another aspect of the present invention, a foldable table comprises: a table top having a top surface and a bottom surface; a frame assembly having a pair of spaced apart side rails, each side rail fixedly coupled to the bottom surface of the table top, each side rail having a spring-biased locking pin extending from an outer surface of the side rail and a corresponding jacket member slidably coupled to the side rail; a pair of leg assemblies, each leg assembly having a pair of spaced apart legs pivotally coupled to the frame assembly; and a plurality of support members each having a proximal end and a distal end, the proximal end of each of the plurality of support members fixedly pivotally connected to a corresponding jacket member and the distal end of each of the plurality of support members fixedly pivotally coupled to a corresponding leg. Each leg assembly is movable between an extended position whereby each leg assembly is substantially perpendicular to the bottom surface of the table top when the locking pin and jacket member are fixedly engaged, and a folded position whereby each leg assembly is substantially parallel and adjacent to the bottom surface of the table top when the locking pin and jacket member are disengaged.

BRIEF DESCRIPTION OF THE DRAWINGS

To better understand the present invention, a more particular description of the invention will be rendered by reference to the appended drawings.

Figure 1:
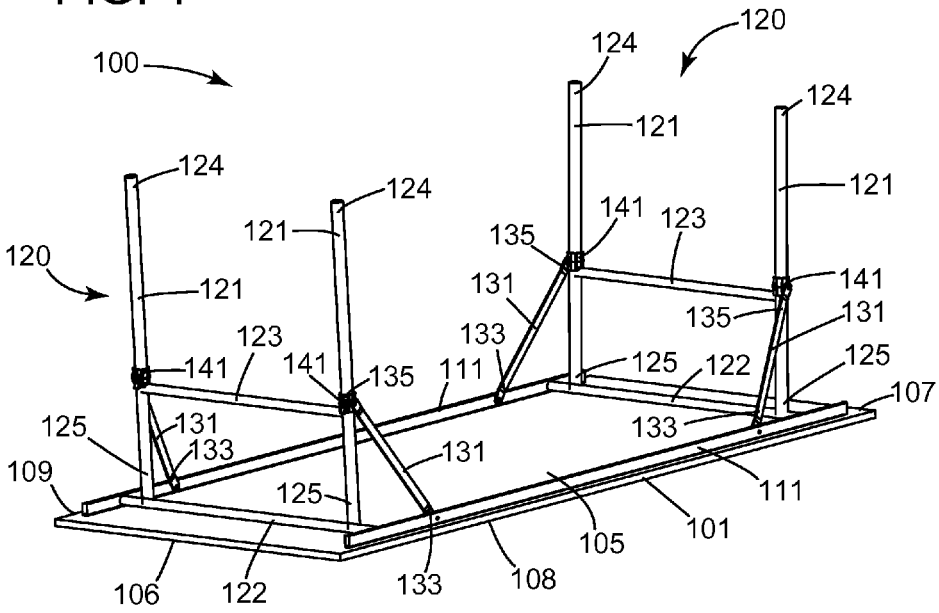
FIG. 1 is a bottom perspective view of a first embodiment of a foldable table of the present invention illustrated in a fully unfolded position.

To facilitate an understanding of the invention, identical reference numerals and component descriptions have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

The present invention relates to a novel table or bench apparatus, and a method of manufacturing the apparatus. In particular, the present invention is directed to a table capable of easily extending and folding, while providing a safety feature for a user's hands. The principles of the present invention, however, are not limited to tables with such features. Specifically, the following description is presented to enable one skilled in the art to make and use the invention, and is provided in the context of particular applications and their requirements. Thus, the following description of embodiments consistent with the present invention provides illustration and description, but is not intended to be exhaustive or to limit the present invention to the precise form disclosed. Various modifications to the disclosed embodiments will be apparent to those skilled in the art, and the general principles set forth below may be applied to other embodiments and applications, including in other types of furniture and structures. Thus, the present invention is not intended to be limited to the embodiments described and shown herein.

Also, certain terminology is used in the following description for convenience only and is not limiting. The article "a" is intended to include one or more items. Where only one item is intended, the term "one" or similar language is used. Additionally, to assist in the description of the table, words such as top, bottom, front, rear, right and left are used to describe the accompanying figures. The terminology includes the words above specifically mentioned, derivatives thereof, and words of similar import.

First Embodiment

Referring to FIGS. 1-4A, a foldable table of the first embodiment 100 generally comprises a table top 101; a pair of side rails 111 fixedly connected to the table top 101; a pair of leg assemblies 120, each leg assembly 120 having a pair of legs 121 and pivotally attached to the pair of side rails 111; and four support members 131, each slidably pivotally attached to a leg 121 on one end and fixedly pivotally attached to a side rail 111 on another end.

As shown in FIG. 1, the table top 101 includes a generally planar top working surface (not shown) and an opposing bottom surface 105 having a periphery bordered by opposing first and second ends 106, 107 and opposing first and second sides 108, 109. Desirably, the table top 101 is sufficiently sized to accommodate multiple users and may have a length of between five to eight feet in length and a width of between two to three feet. However, one skilled in the art will appreciate that the table top 101 could be larger or smaller. In the present embodiment, the table top 101 is generally rectangular but it could have other suitable shapes and configurations such as square, circular, oval and the like, depending on the intended use of the table 100, e.g., utility tables, card tables, personal-sized tables and the like. In addition, the corners and edges of the table top 101 could be rounded to improve the aesthetic appearance and/or for the safety of the user. It is preferred that the table top 101 is constructed of blow-molded plastic but other materials could be used such as wood or other types of plastics without departing from the spirit and scope of the present invention. In one embodiment, the blow-molded table top 101 is vacuum-molded such that a top plate is fixedly adhered to a bottom plate having a plurality of depressions. Each plate could be single or multiple layers with each layer having a thickness between 0.3 mm to 0.4 mm and each plate could consist of plastic material such as ABS, PP, PS or the like. The surfaces of each plate could also be treated with print, film or spray to show a variety of colors and/or texture such as wood grains or marble, or for weather-treatment. The edges of the vacuum molded plastic top and bottom plates are connected to each other by welding or gluing, and the edges could be further reinforced by a variety of conventional methods known in the art such as use of a lining and/or welding.

Referring to FIG. 1, the bottom surface of the table top 105 includes a pair of spaced apart side rails 111 fixedly attached thereto to form a frame assembly. The side rails 111 are preferably constructed of a metal having a substantially rectangular cross-section, but the side rails 111 could be constructed of other materials and take on other shapes without departing from the spirit and scope of the present invention. For example, the side rails could be metal flanges. Each side rail 111 is disposed proximate the first and second sides 108, 109, respectively. In the preferred embodiment, the side rails 111 are fixedly attached to grooves (not shown) integrally formed on the bottom surface 105 of the blow-molded table top 101 and further affixed by fasteners (not shown) such as screws but other types of attachment means such as adhesives could be used. The grooves of the bottom surface 105 could also be constructed so that the side rails 111 could be form-fit such that additional attachment means are not necessary. Alternatively, the bottom surface 105 could be molded with extended grooves such that separate side rails are not required and instead various components, such as leg assemblies, could be attached directly to the grooves with fasteners.

Referring again to FIG. 1, each leg assembly 120 includes a pair of spaced apart legs 121 having lower and upper ends 124, 125. In the preferred embodiment, the legs 121 are constructed of a hollow tubular metal but other shapes and materials could be used without departing from the spirit and scope of the invention. The opposing legs 121 of each leg assembly 120 are fixedly coupled at the upper end 125 with a leg support 122, preferably by welding. Each leg support 122 extends across the width of the table top 101 proximate the first and second ends 106, 107, respectively, and is pivotally coupled to opposing side rails 111. The leg support 122 provides uniform pivotal movement of each opposing leg 121. The opposing legs 121 of each leg assembly 120 are further fixedly coupled, preferably by welding, with a cross bar 123 intermediate the lower and upper ends 124, 125 to provide additional support for a lower portion of each leg assembly 121. It will be appreciated that each leg 121 could be directly pivotally attached to the side rail 111 without the leg support 122. The cross bars 123 of the leg assemblies 120 could also be eliminated such that each leg 121 could pivot independently. The length of each leg assembly 120 is of equal length to provide a level table top 101 and the length of each leg assembly 120 could vary depending on the application of the table 100, e.g., for use as a dining table, meeting table, bedside table, coffee table, living room side table, etc. The legs 121 could also be retractable, as described in more detail below, such that the height of the table 100 could be easily adjusted to different levels.

Referring again to FIG. 1, the foldable table 100 further includes a plurality of support members 131, each having a proximal end 133 (upper portion) and a distal end 135 (lower portion). The proximal end 133 is fixedly pivotally connected to the side rail 111 while the distal end 135 of the support member 131 is pivotally connected a sliding jacket member 141 located on each leg 121.

Figure 4:
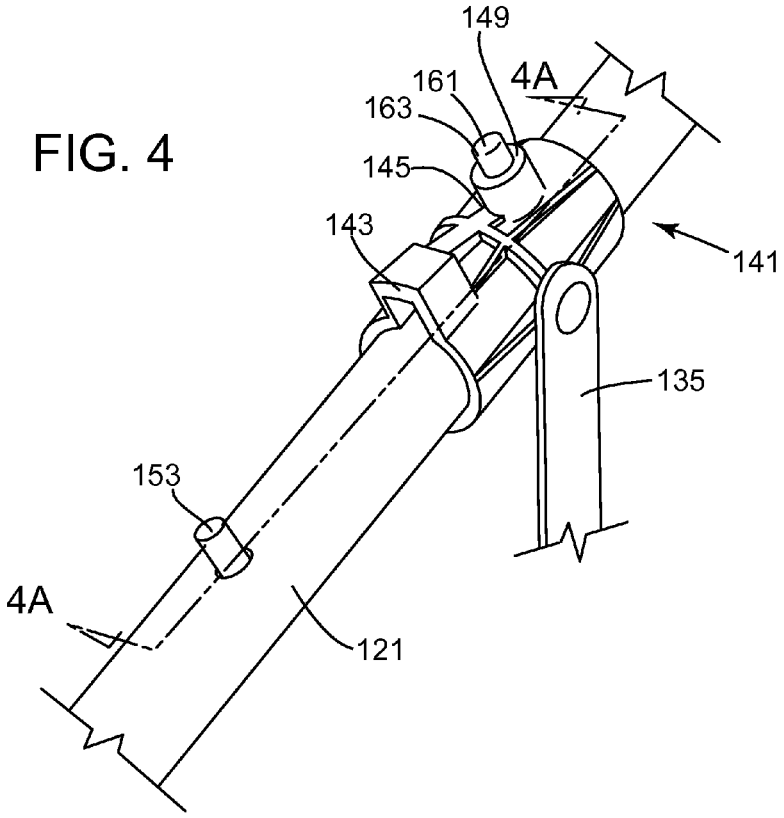
FIG. 4 is a partial perspective view of a portion of a leg assembly of the foldable table of FIG. 1, denoted "4" in FIG. 3.
Figure 4A:
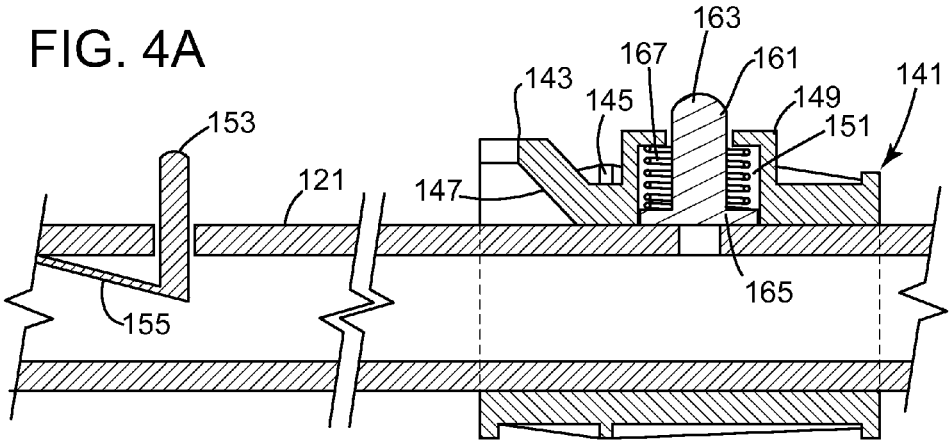
FIG. 4A is a sectional view of the leg assembly in FIG. 4 taken along line "4A-4A"

Referring to FIGS. 4 and 4A, the jacket member 141 is a unitary component constructed of a hard injection-molded plastic and is substantially tubular such that it is slidably connected to each substantially tubular leg 121. However, the jacket member 141 could take on other shapes depending on the shape of the leg 121. The jacket member 141 includes a ramp portion 143 having a guide channel 147 extending along a bottom surface. An intermediate portion 145 bridges the ramp portion 143 and a track lock portion 149 such that they are integrally formed together. The lock portion 149 is hollow and cylindrical, and includes an opening 151 for housing an actuator or push-button 161. In the preferred embodiment, the actuator 161 includes a solid cylinder 163 extending outward from the track lock portion 149 and an integrally formed base 165 having substantially similar dimensions as the opening 151 such that the transverse cross-sectional area of the opening 151 is substantially covered by the base 165 as shown in FIG. 4A. A first biasing member 167 such as a tension spring is disposed around the cylinder 163 and above the base 165 such that the actuator 161 is normally depressed and the base 165 contacts the outer surface of the leg 121.

Referring again to FIGS. 4 and 4A, a spring-loaded pin 153 integrally connected to a second biasing member 155, such as a spring, is disposed within each leg 121, and the pin 153 extends outward from an aperture formed on the leg 121. It will be appreciated by those skilled in the art that the spring-loaded pin 153 may be disposed in the supporting legs 121 through other elastic mechanisms. The second biasing member 155 is constructed such that the upward force of the pin 153 is greater than the downward force of the actuator 161 generated by the first biasing member 167. Also, the height of the pin 153 is less than the clearance between the ramp portion 143 and the leg surface 121. The outer surface of the leg 121 defines a path or track for the jacket member 141 such that the pin 153 is substantially aligned with the ramp portion 143 and lock portion 149 of the jacket member 141. The jacket member 141 is slidable toward the pin 153 until the pin 153 is received within the opening 151 of the lock portion 149. It is preferred that the pin 153 is rounded at an upper end to provide smooth engagement with the guide channel 147 and to minimize friction. The plastic construction of the components of the locking mechanism or jacket member 141 reduces the risk of injury for the user compared with components of the prior art having metal edges. Risk of injury when locking and unlocking the leg assemblies 120 is further reduced because the engaging portion of the locking mechanism 141, i.e., the pin 153 and the actuator base 165, are not exposed.

Figure 2:
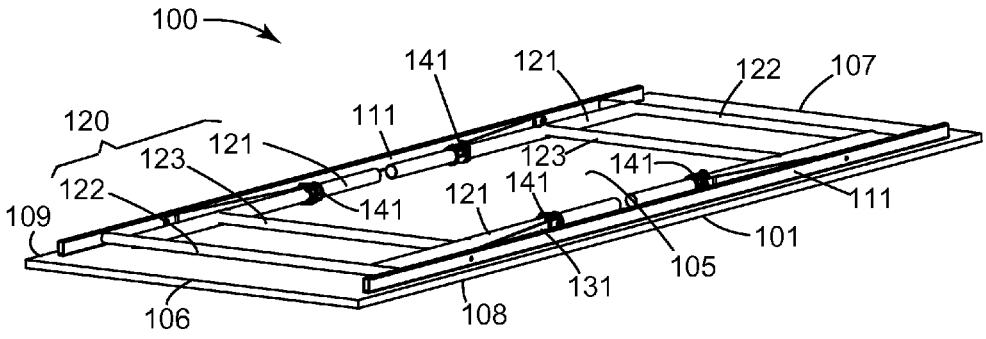
FIG. 2 is a bottom perspective view of the foldable table of FIG. 1 in a fully folded position.
Figure 3:
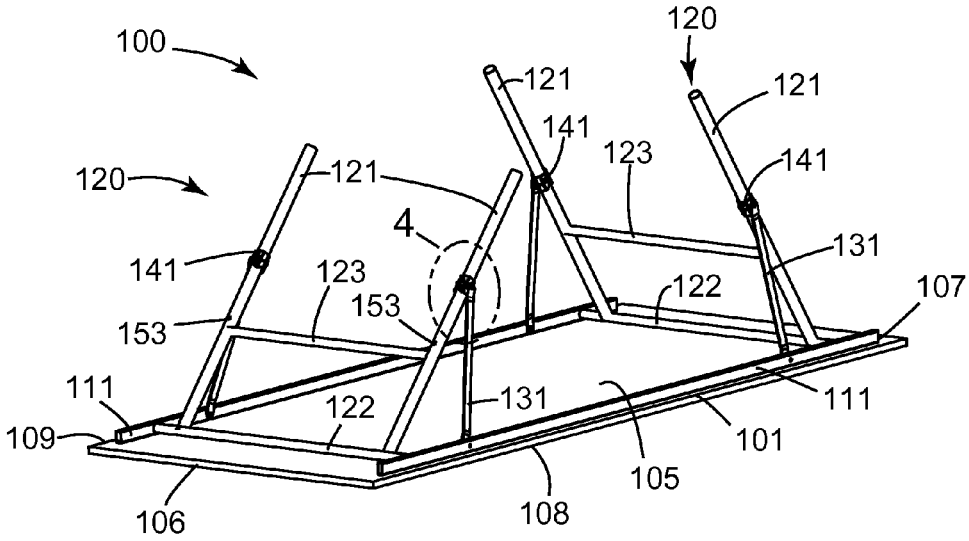
FIG. 3 is a bottom perspective view of the foldable table of FIG. 1 in a partially folded position.

In operation, to set up the table 100 for use, the leg assemblies 120 are pivoted away from the table top 101 from the folded position as shown in FIG. 2. Each jacket member 141 slides along each leg 121 such that the spring-loaded pin 153 is received by the jacket member 141 ramp portion 143 until the pin 153 is biased downward beneath the outer surface of the leg 121. The declined guide channel 147 allows the pin 153 to smoothly transition from an extended state to a depressed state. The jacket member 141 slides further toward the leg upper end 125 as the pin 153 is received by the opening 151. The pin 153 then extends beyond the outer surface of the leg 121 and is engaged with the actuator 161 such that the actuator 161 is moved upward. Thus, the spring-loaded pin 153 and the jacket member 141 are restricted from movement and are engaged in a locked position. In the locked position, the legs 121 are substantially perpendicular to the table top 101 as shown in FIG. 1. To fold the table 100, the pair of actuators 161 on each leg assembly 120 is simultaneously depressed such that each pin 153 is depressed below the inner surface of each leg 121. The leg assemblies 120 are pivoted toward the table top 101 as each jacket member 141 slides toward the leg lower ends 124 and the pin 153 is disengaged from the base 165 and remaining components of the jacket member 141.

Second Embodiment

Referring to FIGS. 5-8A, a foldable table of the second embodiment 200 generally comprises a table top 201; a pair of side rails 211 fixedly connected to the table top 201; a pair of leg assemblies 220, each leg assembly 220 having a pair of legs 221 and pivotally attached to the pair of side rails 211; and four support members 231, each fixedly pivotally attached to a leg 221 on one end and slidably pivotally attached to a side rail 211 on another end.

Figure 5:
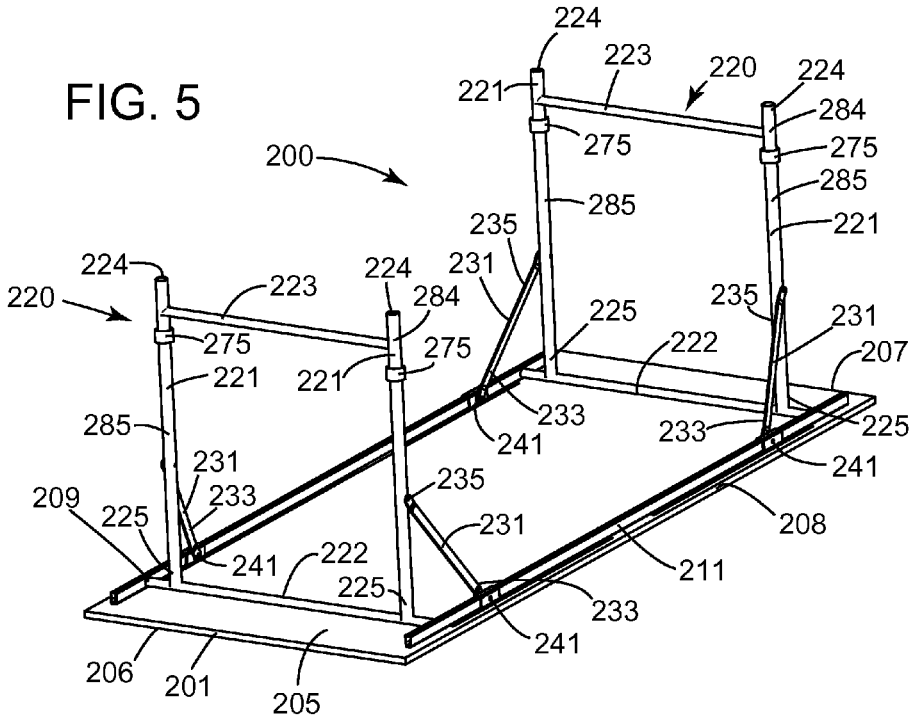
FIG. 5 is a bottom perspective view of a second embodiment of a foldable table of the present invention illustrated in a fully unfolded position.
Figure 6:
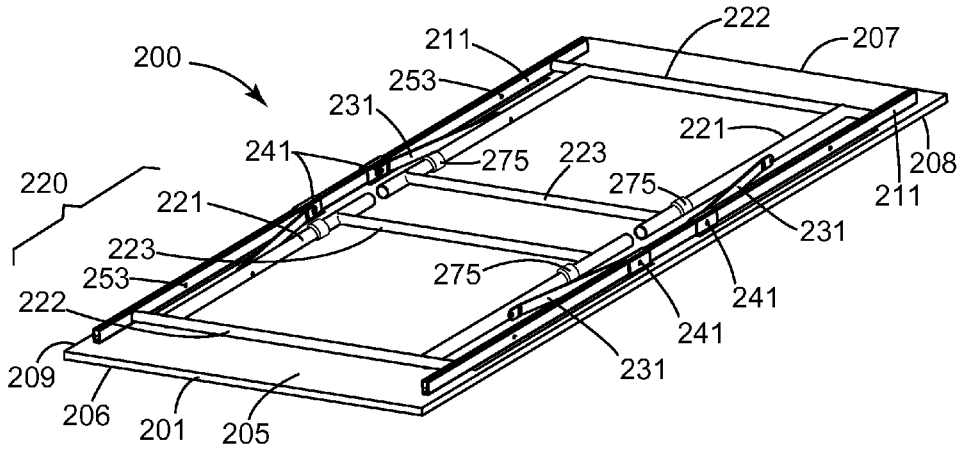
FIG. 6 is a bottom perspective view of the foldable table of FIG. 5 in a fully folded position.
Figure 7:
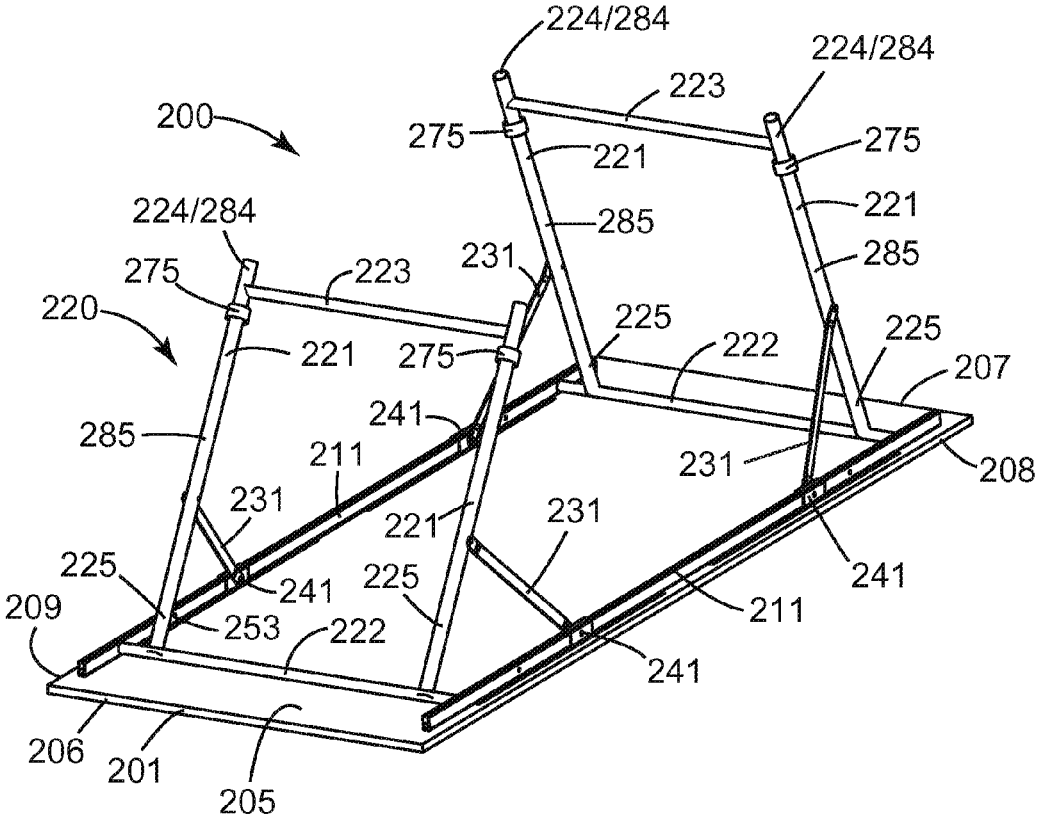
FIG. 7 is a bottom perspective view of the foldable table of FIG. 5 in a partially folded position.

As shown in FIG. 5, the table top 201 includes a generally planar top working surface (not shown) and an opposing bottom surface 205 having a periphery bordered by opposing first and second ends 206, 207 and opposing first and second sides 208, 209. Desirably, the table top 201 is sufficiently sized to accommodate multiple users and may have a length of between five to eight feet in length and a width of between two to three feet. However, one skilled in the art will appreciate that the table top 201 could be larger or smaller. In the present embodiment, the table top 201 is generally rectangular but it could have other suitable shapes and configurations such as square, circular, oval and the like, depending on the intended use of the table 200, e.g., utility tables, card tables, personal-sized tables and the like. In addition, the corners and edges of the table top 201 could be rounded to improve the aesthetic appearance and/or for the safety of the user. It is preferred that the table top 201 is constructed of blow-molded plastic but other materials could be used such as wood or other types of plastics without departing from the spirit and scope of the present invention. In one embodiment, the blow-molded table top 201 is vacuum-molded such that a top plate is fixedly adhered to a bottom plate having a plurality of depressions. Each plate could be single or multiple layers with each layer having a thickness between 0.3 mm to 0.4 mm and each plate could consist of plastic material such as ABS, PP, PS or the like. The surfaces of each plate could also be treated with print, film or spray to show a variety of colors and/or texture such as wood grains or marble, or for weather-treatment. The edges of the vacuum molded plastic top and bottom plates are connected to each other by welding or gluing, and the edges could be further reinforced by a variety of conventional methods known in the art such as use of a lining and/or welding.

Figure 8:
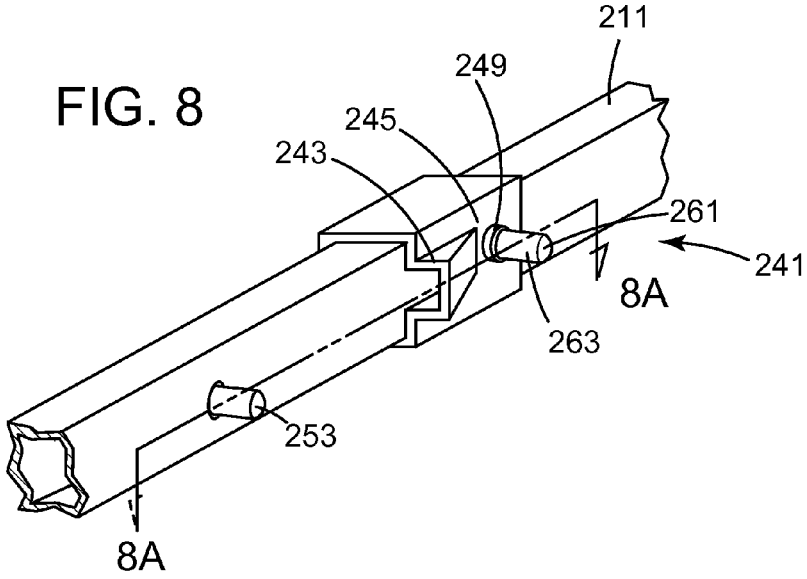
FIG. 8 is a partial perspective view of a side rail of the foldable table of FIG. 5.

Referring to FIG. 5, the bottom surface of the table top 205 includes a pair of spaced apart side rails 211 fixedly attached thereto to form a frame assembly. The side rails 211 are preferably constructed of a hollow metal having a substantially rectangular cross-section as shown in FIG. 8, but the side rails 211 could be constructed of other materials and take on other shapes without departing from the spirit and scope of the present invention. Each side rail 211 is disposed proximate the first and second sides 208, 209, respectively. In the preferred embodiment, the side rails 211 are fixedly attached to grooves (not shown) integrally formed on the bottom surface 205 of the blow-molded table top 201 and further affixed by fasteners such as screws but other types of attachment means such as adhesives could be used. The grooves of the bottom surface 205 could also be constructed so that the side rails 211 could be form-fit such that additional attachment means are not necessary. Alternatively, the bottom surface 205 could be molded with extended grooves such that separate side rails are not required and instead various components, such as leg assemblies, could be attached directly to the grooves with fasteners.

Referring again to FIG. 5, each leg assembly 220 includes a pair of spaced apart legs 221 having lower and upper ends 224, 225. In the preferred embodiment, the legs 221 are constructed of a hollow tubular metal but other shapes and materials could be used without departing from the spirit and scope of the invention. The opposing legs 221 of each leg assembly 220 are fixedly coupled at the upper end 225 with a leg support 222, preferably by welding. Each leg support 222 extends across the width of the table top 201 proximate the first and second ends 206, 207, respectively, and is pivotally coupled to opposing side rails 211. The leg support 222 provides uniform pivotal movement of each opposing leg 221. The opposing legs 221 of each leg assembly 220 are further fixedly coupled, preferably by welding, with a cross bar 223 intermediate the lower and upper ends 224, 225 to provide additional support for a lower portion of each leg assembly 221. It will be appreciated by those skilled in the art that each leg 221 could be directly pivotally attached to the side rails 211 without the leg support 222. The cross bars 223 of the leg assemblies 220 could also be eliminated such that each leg 221 could pivot independently. The length of each leg assembly 220 is of equal length to provide a level table top 201 and the length of each leg assembly 220 could vary depending on the application of the table 200, e.g., for use as a dining table, meeting table, bed-side table, coffee table, living room side table, etc. In the preferred embodiment, each leg 221 includes a lower section 284 telescopically extendable and retractable from an upper section 285 such that the height of the table 200 could be easily adjusted to different levels. That is, the inner cross-sectional dimension of the upper section 285 is substantially similar to the outer cross-sectional dimension of the lower section 284 such that the lower section 284 is slidable within the upper section 285. The upper section 285 is provided with an aperture (not shown) for receiving a spring-biased button (not shown) disposed within the lower section 284 when the leg assemblies 220 are extended. One of ordinary skill with recognize that the upper section 285 could be provided with a plurality of apertures to provide multiple levels of height adjustment. The leg assemblies 220 are retracted as the button is depressed and disengaged with the aperture. A grommet 275 is fixedly attached to an end of each upper section 285 to support and reinforce the movement of the lower section 284.

Referring again to FIG. 5, the foldable table 200 further includes a plurality of support members 231, each having a proximal end 233 (upper portion) and a distal end 235 (lower portion). The proximal end 233 is slidably pivotally connected to a sliding jacket member 241 located on the side rail 211 while the distal end 235 of the support member 231 is fixedly pivotally connected to each leg 221.

Figure 8A:
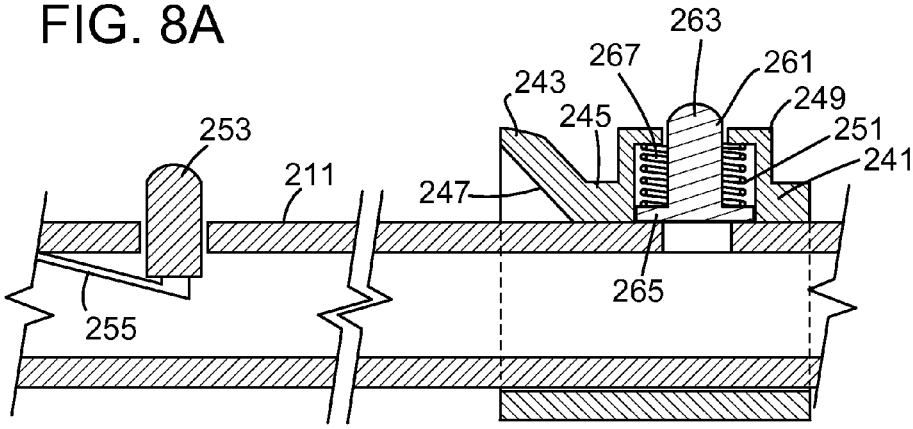
FIG. 8A is a sectional view of the side rail in FIG. 8 taken along line "8A-8A."

Referring to FIGS. 8 and 8A, the jacket member 241 is a unitary component constructed of a hard injection-molded plastic and is substantially hollow with a substantially square cross-section such that it is slidably connected to each substantially hollow, square beam 211. However, the jacket member 241 could take on other shapes depending on the shape of the side rail 211. The jacket member 241 includes a ramp portion 243 having a guide channel 247 extending along a bottom surface. An intermediate portion 245 bridges the ramp portion 243 and a lock portion 249 such that they are integrally formed together. The lock portion 249 is hollow and cylindrical, and includes an opening 251 for housing an actuator or push-button 261. In the preferred embodiment, the actuator 261 includes a solid cylinder 263 extending outward from the track lock portion 249 and an integrally formed base 265 having substantially similar dimensions as the opening 251 such that the transverse cross-sectional area of the opening 251 is substantially covered by the base 265 as shown in FIG. 8A. A first biasing member 267 such as a tension spring is disposed around the cylinder 263 and above the base 265 such that the actuator 261 is normally depressed and the base 265 contacts the outer surface of the side rail 211.

Referring again to FIGS. 8 and 8A, a spring-loaded pin 253 integrally connected to a second biasing member 255, such as a spring, is disposed within each side rail 211, and the pin 253 extends outward from an aperture formed on the side rail 211. It will be appreciated by those skilled in the art that the spring-loaded pin 253 may be disposed in the side rail 211 through other elastic mechanisms. The second biasing member 255 is constructed such that the upward force of the pin 253 is greater than the downward force of the actuator 261 generated by the first biasing member 267. Also, the height of the pin 253 is less than the clearance between the ramp portion 243 and the side rail surface 211. The side rail 211 defines a path or track for the slidable jacket member 241 such that the pin 253 is substantially aligned with the ramp portion 243 and lock portion 249 of the jacket member 241. The jacket member 241 is slidable toward the pin 253 until the pin 253 is received within the opening 251 of the lock portion 249. It is preferred that the pin 253 is rounded at an upper end to provide smooth engagement with the guide channel 247 and to minimize friction. The plastic construction of the components of the locking mechanism or jacket member 241 reduces the risk of injury for the user compared with components of the prior art having metal edges. Risk of injury when locking and unlocking the leg assemblies 220 is further reduced because the engaging portion of the locking mechanism 241, i.e., the pin 253 and the actuator base 265, are not exposed.

In operation, to set up the table 200 for use, the leg assemblies 220 are pivoted away from the table top 201 from the folded position as shown in FIG. 2. Each jacket member 241 slides along each side rail 211 such that the spring-loaded pin 253 is received by the jacket member 241 ramp portion 243 until the pin 253 is biased downward beneath the outer surface of the side rail 211. The declined guide channel 247 allows the pin 253 to smoothly transition from an extended state to a depressed state. Each respective jacket member 241 slides further toward the first and second ends 206, 207 as the pin 253 is received by the opening 251. The pin 253 extends beyond the outer surface of the side rail 211 and is engaged with the actuator 261 such that the actuator 261 is moved upward. Thus, the spring-loaded pin 253 and the jacket member 241 are restricted from movement and are engaged in a locked position. In the locked position, the legs 221 are substantially perpendicular to the table top 201 as shown in FIG. 5. To fold the table 200, the actuators 261 of each leg assembly 220 are simultaneously depressed such that each pin 253 is depressed below the inner surface of each side rail 211. The leg assemblies 220 are pivoted toward the table top 201 as each jacket member 241 slides toward the mid-portions of the beams 211 and the pin 253 is disengaged from the base 265 and remaining components of the jacket member 241.

While the foregoing is directed to embodiments of the present invention, other and further embodiments of the invention can be devised without departing from the basic scope thereof, and the scope thereof is determined by the claims that follow.

The invention claimed is:

1. A foldable table comprising:

a table top having a top surface and a bottom surface;

a frame assembly having a pair of spaced apart side rails, each side rail fixedly coupled to the bottom surface of the table top;

a pair of leg assemblies, each leg assembly having a pair of spaced apart legs pivotally coupled to the frame assembly, each leg having a spring-biased locking pin extending from an outer surface of the leg and a corresponding jacket member slidably coupled to the leg, each said corresponding jacket member being slidably mounted to and circumscribing at least a portion of a corresponding one of the legs to selectively engage and disengage a corresponding one of the spring-biased locking pins; and a plurality of support members each having a proximal end and a distal end, the proximal end of each of the plurality of support members fixedly pivotally connected to a corresponding side rail and the distal end of each of the plurality of support members pivotally coupled to a corresponding jacket member;

wherein each leg assembly is selectively movable between an extended position and a folded position, such that in the extended position each leg assembly is positioned substantially perpendicular with respect to the bottom surface of the table top and the locking pin interfaces and engages with an engagement member of the corresponding one of the jacket members, and such that in the folded position each leg assembly is positioned substantially parallel and adjacent to the bottom surface of the table top and each of the jacket members is selectively disengaged with and slidably displaced from the corresponding one of the locking pins by the engagement member.

2. The foldable table of claim 1, wherein the jacket member comprises a ramp portion extending from and integrally formed with a locking portion, the ramp portion having a sloped channel formed between a bottom surface of the ramp portion and the outer surface of the leg, the sloped channel configured to slidably receive, guide and selectively engage and move the locking pin, the locking portion having an opening configured to receive therein the locking pin from the sloped channel, and wherein the engagement member is aligned over the opening and configured to selectively engage and move the locking pin.

3. The foldable table of claim 2, wherein the engagement member is a spring-biased pushbutton and in the extended position the locking pin engages the pushbutton such that the pushbutton is biased upward and the locking pin is received in the opening.

4. The foldable table of claim 1, wherein the bottom surface of the table top comprises a plurality of grooves for receiving the pair of side rails.

5. The foldable table of claim 1, wherein the table top is blow-molded plastic.

6. The foldable table of claim 1, wherein each leg assembly comprises at least one lateral support bar fixedly attached to opposing legs.

7. A foldable table comprising:

a table top having a top surface and a bottom surface;

a frame assembly having a pair of spaced apart side rails, each side rail fixedly coupled to the bottom surface of the table top, each side rail having a spring-biased locking pin extending from an outer surface of the side rail and a corresponding jacket member slidably coupled to the side rail, each said corresponding jacket member being slidably mounted to and circumscribing at least a portion of a corresponding one of the side rails to selectively engage and disengage a corresponding one of the spring-biased locking pins;

a pair of leg assemblies, each leg assembly having a pair of spaced apart legs pivotally coupled to the frame assembly; and a plurality of support members each having a proximal end and a distal end, the proximal end of each of the plurality of support members fixedly pivotally connected to a corresponding jacket member and the distal end of each of the plurality of support members fixedly pivotally coupled to a corresponding leg;

wherein each leg assembly is selectively movable between an extended position and a folded position, such that in the extended position each leg assembly is positioned substantially perpendicular with respect to the bottom surface of the table top and the locking pin interfaces and engages with an engagement member of the corresponding one of the jacket members, and such that in the folded position each leg assembly is positioned substantially parallel and adjacent to the bottom surface of the table top and each of the jacket members is selectively disengaged with and slidably displaced from the corresponding one of the locking pins by the engagement member.

8. The foldable table of claim 7, wherein the jacket member comprises a ramp portion extending from and integrally formed with a locking portion, the ramp portion having a sloped channel formed between a bottom surface of the ramp portion and the outer surface of the side rail, the sloped channel configured to slidably receive, guide and selectively engage and move the locking pin, the locking portion having an opening configured to receive therein the locking pin from the sloped channel, and wherein the engagement member is aligned over the opening and configured to selectively engage and move the locking pin.

9. The foldable table of claim 8, wherein the engagement member is a spring-biased pushbutton and in an extended position the locking pin engages the pushbutton such that the pushbutton is biased upward and the locking pin is received in the opening.

10. The foldable table of claim 7, wherein the bottom surface of the table top comprises a plurality of grooves for receiving the pair of side rails.

11. The foldable table of claim 7, wherein the table top is blow-molded plastic.

12. The foldable table of claim 7, wherein each pair of legs of each leg assembly comprises at least one lateral support bar fixedly attached to opposing legs of each leg assembly.

13. A foldable table comprising:

a table top having a top surface and a bottom surface;

a frame assembly disposed on a bottom surface of the table top;

at least two leg assemblies pivotally coupled to the frame assembly, each of the at least two leg assemblies movable between an extended position and a folded position, such that in the extended position each leg assembly is positioned substantially perpendicular to the bottom surface of the table top, and such that in the folded position each leg assembly is positioned substantially parallel and adjacent to the bottom surface of the table top;

at least two support members, each support member pivotally coupled to the frame assembly and the at least two leg assemblies; and a locking assembly coupled to a corresponding one of the at least two support members, each of the at least one locking assembly comprising a ramp portion extending from and integrally formed with a locking portion, a sloped channel formed under the ramp portion and including at least one surface configured to slidably receive, guide and selectively engage and move a locking pin, the locking portion having an opening configured to receive the locking pin from the sloped channel, and a spring-biased pushbutton aligned over the opening and configured to selectively engage and move the locking pin.

14. The foldable table of claim 13, wherein the locking pin extends from an outer surface of the at least two leg assemblies, and the locking assembly is slidably mounted to the corresponding one of the at least two leg assemblies such that the sloped channel is aligned and movable with respect to the locking pin.

15. The foldable table of claim 13, wherein the locking pin extends from an outer surface of the frame assembly, and the locking assembly is slidably mounted to a portion of the frame assembly such that the sloped channel is aligned and movable with respect to the locking pin.

16. The foldable table of claim 13, wherein each leg assembly comprises at least one lateral support bar.

17. The foldable table of claim 13, wherein the table top is blow-molded plastic.

* * * * *